US010662772B2

(12) United States Patent
Wang et al.

(10) Patent No.: US 10,662,772 B2
(45) Date of Patent: May 26, 2020

(54) POSITIONER AND POSITIONING METHOD FOR REINFORCING STEEL BARS OF TUNNEL SIDE WALL

(71) Applicant: CRRC CONSTRUCTION ENGRG. CO., LTD., Chongqing (CN)

(72) Inventors: Meng Wang, Chongqing (CN); Yong Li, Chongqing (CN); Cheng Wang, Chongqing (CN)

(73) Assignee: CRRC Construction Engrg. Co., Ltd. (CN)

( * ) Notice: Subject to any disclaimer, the term of this patent is extended or adjusted under 35 U.S.C. 154(b) by 0 days.

(21) Appl. No.: 16/469,283

(22) PCT Filed: Nov. 29, 2017

(86) PCT No.: PCT/CN2017/113628
§ 371 (c)(1),
(2) Date: Jun. 13, 2019

(87) PCT Pub. No.: WO2018/113492
PCT Pub. Date: Jun. 28, 2018

(65) Prior Publication Data

US 2020/0003057 A1 Jan. 2, 2020

(30) Foreign Application Priority Data

Dec. 20, 2016 (CN) ..... 2016 1 1190302

(51) Int. Cl.
*E21D 11/40* (2006.01)
*E21D 11/14* (2006.01)

(52) U.S. Cl.
CPC ..... *E21D 11/14* (2013.01); *E21D 11/40* (2013.01)

(58) Field of Classification Search
CPC ..... E21D 11/00; E21D 9/00
See application file for complete search history.

(56) References Cited

U.S. PATENT DOCUMENTS 6,089,162 A * 7/2000 Madison ..... E01B 29/10 104/2
2014/0007529 A1 1/2014 Alvarez Moysen

FOREIGN PATENT DOCUMENTS

CN 2515424 Y 10/2002
CN 202788875 U 3/2013
(Continued)

OTHER PUBLICATIONS

PCT International Search Report dated Feb. 24, 2018 for Intl. App. No. PCT/CN2017/113628, from which the instant application is based, 2 pgs.

*Primary Examiner* — Sean D Andrish
(74) *Attorney, Agent, or Firm* — Fredrikson & Byron, P.A.

(57) ABSTRACT

Provided is a positioner for reinforcing steel bars of tunnel side wall. At least two groups of reinforcing steel bar positioning arm mechanisms are provided on the same side of an inverted trestle (4). The reinforcing steel bar positioning arm mechanism comprises a large arm (1), a medium arm (2) and a small arm (3). The large arm (1) is driven by a first telescopic cylinder (7) to rotate around a hinge point, such that the large arm (1) implements rotation in the horizontal direction. The medium arm (2) is composed of three second telescopic cylinders (8) in a Z-shaped arrangement in the vertical plane, such that the small arm (3) implements rotation or expansion in the vertical plane. Two arm rods of the small arm (3) are each provided with a third telescopic cylinder (9) to implement the expansion of the arm rod.

5 Claims, 4 Drawing Sheets

(56) References Cited

FOREIGN PATENT DOCUMENTS

| | | | | |
|---|---|---|---|---|
| CN | 204327120 | U | | 5/2015 |
| CN | 105317439 | A | | 2/2016 |
| CN | 105422143 | A | | 3/2016 |
| CN | 105537898 | A | | 5/2016 |
| CN | 105736016 | A | | 7/2016 |
| CN | 105863682 | A | | 8/2016 |
| CN | 106050272 | A | | 10/2016 |
| CN | 106640144 | A | | 5/2017 |
| FR | 70172 | | * | 2/1959 |
| FR | 2262718 | | * | 9/1975 |
| JP | 9132930 | A | | 5/1997 |
| KR | 101229155 | B1 | | 2/2013 |

* cited by examiner

POSITIONER AND POSITIONING METHOD FOR REINFORCING STEEL BARS OF TUNNEL SIDE WALL

RELATED APPLICATIONS

This application is a 35 U.S.C. 371 national stage filing from International Application No. PCT/CN017/113628, filed Nov. 29, 2019, which claims priority to Chinese Application No. 201611190302.5, filed Dec. 20, 2016, the teachings of which are incorporated herein by reference.

CROSS-REFERENCE

The present application claims priority to Chinese Patent Application No. 2016111903025, filed on Dec. 20, 2016, entitled "Positioner and Positioning Method for Reinforcing Steel Bars of Tunnel Side Wall", the disclosure of which is incorporated herein by reference in its entirety.

FIELD OF TECHNOLOGY

The present application relates to tunnel support devices, and specifically to a positioner and positioning method for reinforcing steel bars of tunnel side wall.

BACKGROUND

During tunnel lining construction, it is very difficult to position the reinforcing steel bars of the side wall while reinforcement binding, and it is impossible to accurately perform a three-dimensional positioning for the reinforcing steel bar. Problems often occur that the spacing between two reinforcing steel bars is not constant, the thickness of the protective layer of the reinforcing steel bar is too large or too small, the reinforcing steel bars press against the waterproof board to cause puncture of the waterproof board, and the excessive cutting stock causes waste of the reinforcing steel bars etc., which seriously affects the quality of the lining construction, resulting in poor durability of the tunnel structure. There are some reinforcing steel bar positioners in the prior art, but these reinforcing steel bar positioners cannot absolutely position the reinforcing steel bars (i.e., three-dimensional positioning in the X, Y and Z directions), the spacing between two reinforcing steel bar positioners is difficult or impossible to adjust, and the inner reinforcing steel bars and the outer reinforcing steel bars of the side wall cannot be simultaneously positioned (especially in the case that the reinforcing steel bars of the side wall have different heights). A method and device for three-dimensional accurate positioning of the reinforcing steel bar of the side wall has not been found.

SUMMARY

The present application aims to provide a method and device that can accurately and three-dimensionally position the inner layer and the outer layer reinforcing steel bars of the side wall at the same time, and particularly a reinforcing steel bar positioner that can position the side wall reinforcing steel bars with different heights at one time, as well as be convenient to operate and have high efficiency. In the meantime, accurate positioning facilitates the standardization of the cutting stock of the reinforcing steel bars, and reduces or avoids reinforcing steel bar waste.

Therefore, the technical solutions applied by the present application are: a positioner for reinforcing steel bars of tunnel side wall, including an inverted trestle, reinforcing steel bar positioning arm mechanisms, positioning rods and positioning clamps; wherein at least two groups of the reinforcing steel bar positioning arm mechanisms are provided on the same side of the inverted trestle, each group of the reinforcing steel bar positioning arm mechanisms comprises a large arm, a medium arm and a small arm that are hinged sequentially from inside to outside; an inner side end of the large arm is hinged at an outer side of the inverted trestle, and the large arm is driven by a first telescopic cylinder to rotate around a hinge point, such that the large arm achieves rotation in a horizontal direction; the medium arm comprises three second telescopic cylinders in a Z-shaped arrangement in a vertical plane, such that the small arm achieves rotation or expansion in the vertical plane; the small arm comprises two arm rods vertically arranged at an interval, each of the arm rods is provided with a third telescopic cylinder to achieve telescoping of the arm rod, and a forth telescopic cylinder is provided between inner side ends of the two arm rods for adjusting a distance between the two arm rods of the small arm; the small arms of the two groups of the reinforcing steel bar positioning arm mechanisms on the same side are connected to each other through four positioning rods, wherein, two of the positioning rods are vertically arranged at an interval on inner sides of the small arms, and the other two positioning rods are vertically arranged at an interval on outer sides of the small arms, with several positioning clamps being fixedly distributed at intervals on each of the positioning rods; the reinforcing steel bar positioning clamps on the positioning rods above the inner side are arranged correspondingly to the reinforcing steel bar positioning clamps on the positioning rods below the outer side, the reinforcing steel bar positioning clamps on the positioning rods below the inner side are arranged correspondingly to the reinforcing steel bar positioning clamps on the positioning rods above the outer side, and the reinforcing steel bar positioning clamps on the positioning rods above the inner side are staggered to the reinforcing steel bar positioning clamps on the positioning rods below the inner side.

Alternatively, the large arm is in a U-shape, and an opening end of the U-shape faces the inner side, and two end heads of the large arm are hinged to the inverted trestle vertically at an interval; the first telescopic cylinder is arranged vertically and centrally to the large arm so as to ensure that the large arm has a force balance.

Further, the arm rod of the small arm can rotate relative to the medium arm, so as to ensure that the reinforcing steel bar positioner can be folded to occupy small space.

At the same time, the present application further provides a positioning method for reinforcing steel bars of tunnel side wall using the positioner for reinforcing steel bars of tunnel side wall above, including the following steps:

a first step, positioning the inverted trestle, wherein one end of the inverted trestle is supported on paved inverted arch, and the other end is supported on a side where the inverted arch is not paved; and a center line of the inverted trestle is parallel to a center line of the tunnel; a second step, extending, shortening and rotating each arm of the reinforcing steel bar positioner so that a position of the reinforcing steel bar positioner in a vertical section of the tunnel is determined, and then adjusting distances between the reinforcing steel bar positioning clamps so that a position of the reinforcing steel bar positioner in a length direction of the tunnel is determined, thereby achieving three-dimensional positioning of the reinforcing steel bar positioner; a third step, clamping side wall reinforcing steel bars with the reinforcing steel bar positioning clamps so as to achieve three-dimensional positioning for the side wall reinforcing steel bars.

Alternatively, a center line of the inverted trestle and a center line of the tunnel are in the same vertical plane.

The advantageous effects of the present application: the inner layer reinforcing steel bars and outer layer reinforcing steel bars having different heights of the tunnel side wall can be positioned three-dimensionally at the same time; the forth telescopic cylinder is provided between the inner side ends of the two arm rods for adjusting the distance between the two arm rods of the small arm, so as to adapt the side wall reinforcing steel bars with different heights; the positioning accuracy is high, and the intervals between reinforcing steel bars are standard, which facilitates improving the quality of the lining construction; the reinforcing steel bars can have standard cutting stock, to avoid or reduce the reinforcing steel bar waste; the interval of the positioner is easy to adjust and the mechanization level is high, to reduce the labor intensity of workers.

DESCRIPTION OF THE EMBODIMENTS

The present application will be further described hereinafter through the embodiments and with reference to the accompanying drawings.

As shown in FIG. 1 to FIG. 4, a positioner for reinforcing steel bars of tunnel side wall mainly includes an inverted trestle 4, reinforcing steel bar positioning arm mechanisms, positioning rods 5 and positioning clamps 6.

The inverted trestle 4 has a left side and a right side. The left side and right side of the inverted trestle 4 are each provided with two groups of reinforcing steel bar positioning arm mechanisms. At least two groups of the reinforcing steel bar positioning arm mechanisms should be provided on the same side of the inverted trestle, and the number of the group is not limited by two.

Figure 1:
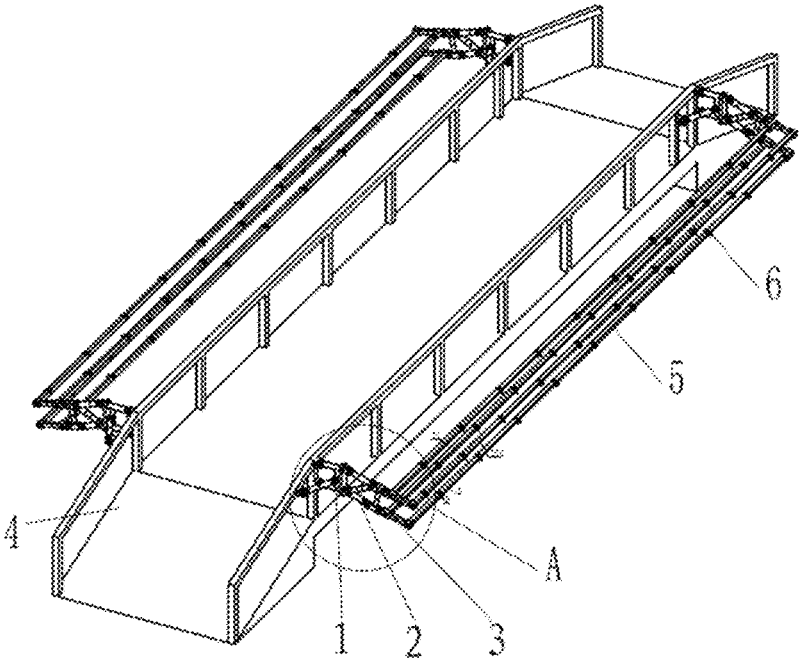
FIG. 1 is a structural diagram of the positioner in an unfolded state according to an embodiment.
Figure 2:
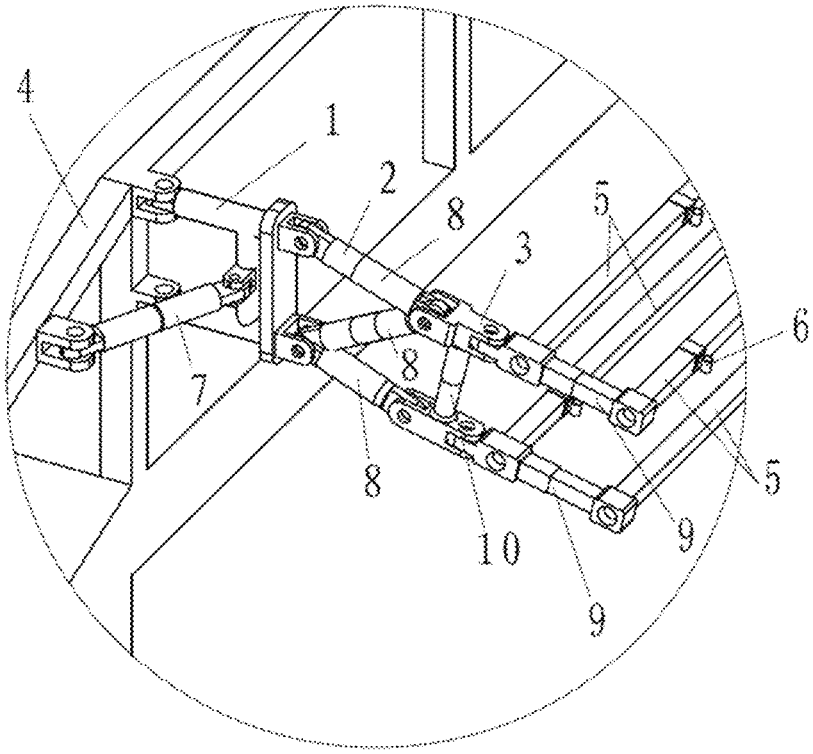
FIG. 2 is an enlarged view of part A of FIG. 1.
Figure 3:
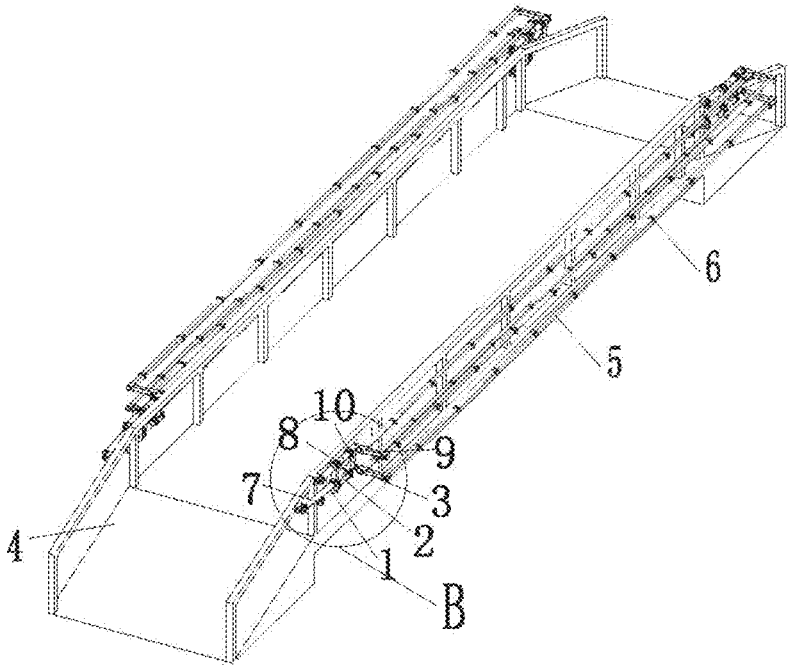
FIG. 3 is a structural diagram of the positioner in a folded state according to an embodiment.
Figure 4:
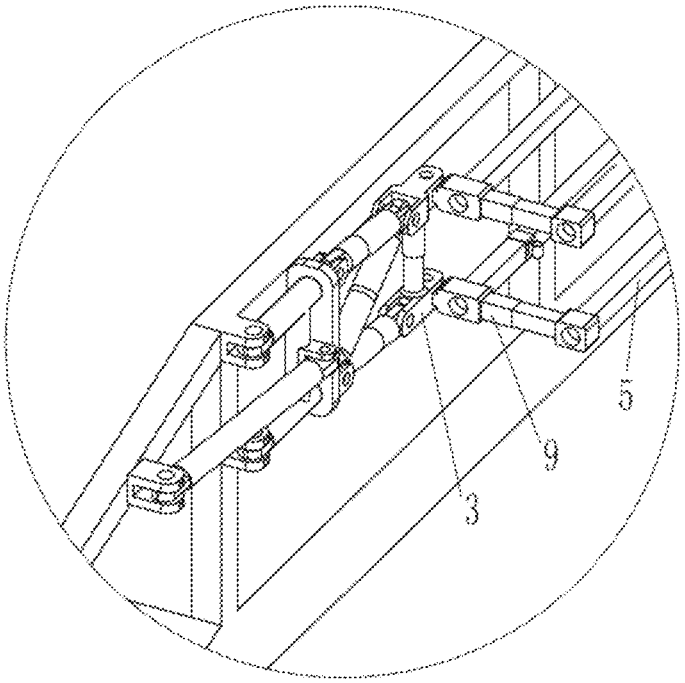
FIG. 4 is an enlarged view of part B of FIG. 2.
Figure 5:
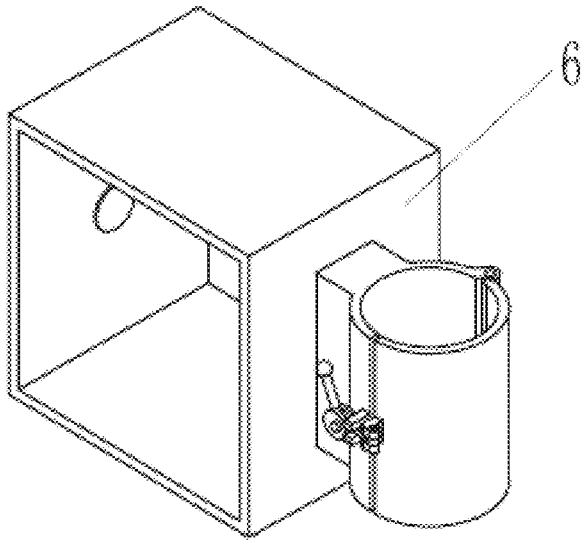
FIG. 5 is a schematic diagram showing the positioning clamp from the unlocking state to the locking state.
Figure 6:
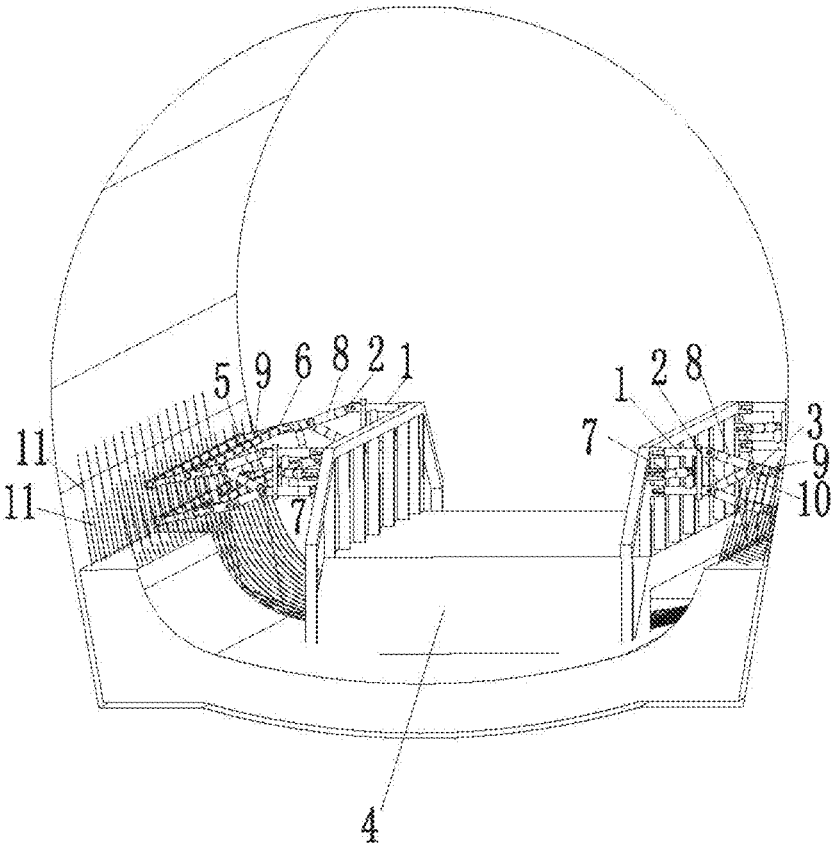
FIG. 6 is a diagram showing the relations of the tunnel, the reinforcing steel bars and the reinforcing steel bar positioner.
Figure 7:
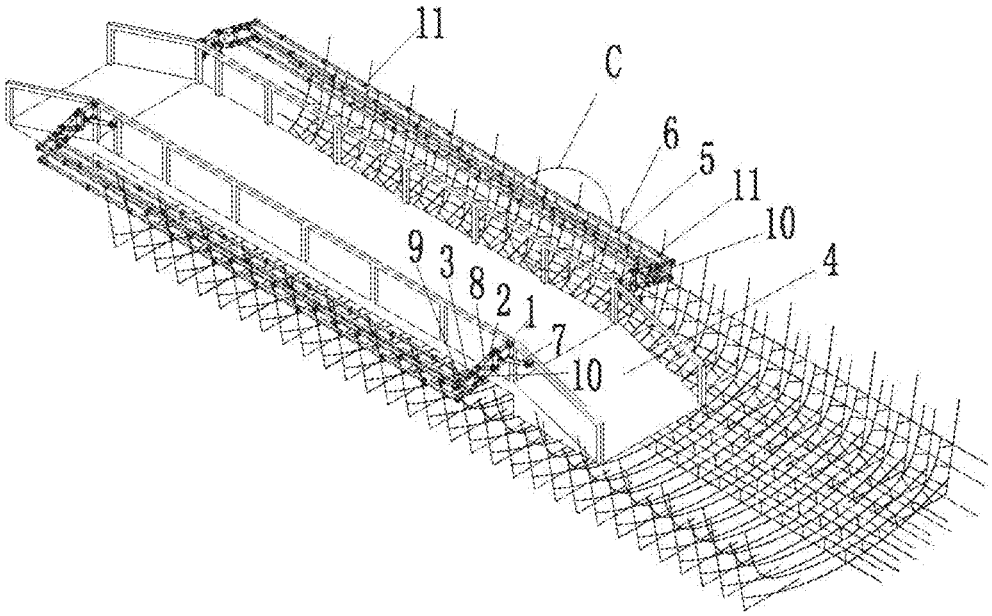
FIG. 7 is a schematic diagram showing the installation of the reinforcing steel bars on the reinforcing steel bar positioner.
Figure 8:
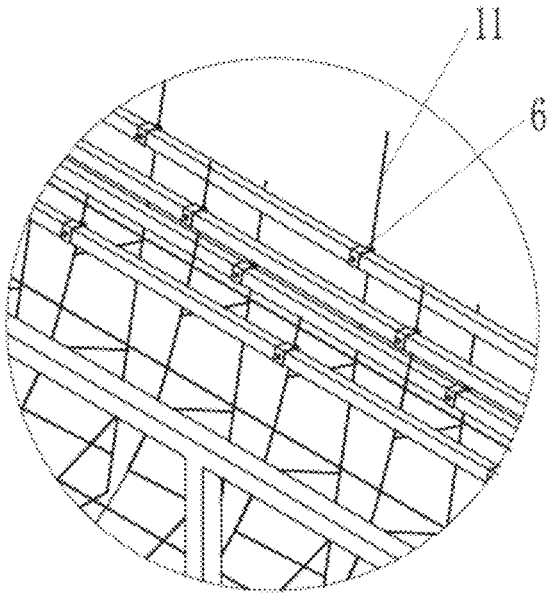
FIG. 8 is an enlarged view of part C of FIG. 7.

Each group of the reinforcing steel bar positioning arm mechanism includes a large arm 1, a medium arm 2 and a small arm 3 that are hinged sequentially from inside to outside. The inner side end of the large arm 1 is hinged at the outer side of the inverted trestle 4, and the large arm 1 is driven by a first telescopic cylinder 7 to rotate around the hinge point, such that the large arm 1 achieves rotation in the horizontal direction. The reinforcing steel bar positioner has a working state and a folding state (as shown in FIG. 2 and FIG. 4). The purpose of providing the first telescopic cylinder 7 is to ensure that the reinforcing steel bar positioner can horizontally rotate around the hinge point at the inner side of the large arm 1 after working so as to achieve folding, thereby reducing the occupied space. Alternatively, the large arm 1 also has a telescoping function achieved by an additional telescopic cylinder.

The medium arm 2 includes three second telescopic cylinders 8 in a Z-shaped arrangement in the vertical plane, such that the small arm 3 achieves rotation or expansion in the vertical plane. The inner end of each second telescopic cylinder 8 is hinged to the outer side end of the large arm 1, and the outer end of each second telescopic cylinder 8 is hinged to the inner side end of the small arm 3. The three second telescopic cylinders 8 are in a Z-shaped arrangement in the vertical plane, wherein, the inner side end of the inclined second telescopic cylinder 8 shares one hinge point with the inner side end of the second telescopic cylinder 8 below; the outer side end of the inclined second telescopic cylinder 8 shares one hinge point with the outer side end of the second telescopic cylinder 8 above. Alternatively, the inner side end of the inclined second telescopic cylinder 8 shares one hinge point with the inner side end of the second telescopic cylinder 8 above; the outer side end of the inclined second telescopic cylinder 8 shares one hinge point with the outer side end of the second telescopic cylinder 8 below.

The small arm 3 includes two arm rods vertically arranged at an interval, each of the arm rods is provided with a third telescopic cylinder 9 to achieve the telescoping of the arm rod, and a forth telescopic cylinder 10 is provided between the inner side ends of the two arm rods for adjusting the distance between the two arm rods of the small arm 3.

The small arms 3 of the two groups of the reinforcing steel bar positioning arm mechanisms on the same side are connected to each other through four positioning rods 5, wherein, two of the positioning rods 5 are vertically arranged at an interval on the inner sides of the small arms 3, and the other two positioning rods 5 are vertically arranged at an interval on the outer sides of the small arms 3, with several positioning clamps 6 being fixedly distributed at intervals on each positioning rod 5. As shown in FIG. 5 to FIG. 8, the positioning clamp 6 is for fixing the reinforcing steel bar 11 of the tunnel side wall. The reinforcing steel bar positioning clamps 6 on the positioning rods 5 above the inner side are arranged correspondingly to the reinforcing steel bar positioning clamps 6 on the positioning rods 5 below the outer side, and the reinforcing steel bar positioning clamps 6 on the positioning rods 5 below the inner side are arranged correspondingly to the reinforcing steel bar positioning clamps 6 on the positioning rods 5 above the outer side. And the reinforcing steel bar positioning clamps 6 on the positioning rods 5 above the inner side are staggered to the reinforcing steel bar positioning clamps 6 on the positioning rods 5 below the inner side.

Alternatively, the large arm 1 is in a U-shape, and the opening end of the U-shape faces the inner side. And the two end heads of the large arm 1 are hinged to the inverted trestle 4 vertically at an interval. The first telescopic cylinder 7 is arranged vertically and centrally to the large arm 1 so as to ensure that the large arm 1 has a force balance.

In addition, the arm rods of the small arm 3 can rotate relative to the medium arm 2, as shown in FIG. 4, so as to ensure that the reinforcing steel bar positioner occupies the smallest space after folding.

It should be noted that:

(1) In the working state, the large arm 1, the medium arm 2 and the small arm 3 are coplanar in the vertical plane, and are always perpendicular to the side wall of the inverted trestle 4; in the folding state, the large arm 1 and the medium arm 2 are coplanar in the vertical plane, and the arm rods of the small arm 3 can rotate relative to the medium arm 2 to form an angel, so as to ensure that the smallest space is occupied after folding. During the folding or unfolding process, the large arm 1 and the medium arm 2 are coplanar in the vertical plane, the upper second telescopic cylinder 8 of the medium arm 2 and the lower second telescopic cylinder 8 of the medium arm 2 have the same length, and the medium arm 2 and the small arm 3 can rotate relative to each other (the positioning rod is always longitudinally parallel to the inverted trestle). After folding, the medium arm 2 is perpendicular to the small arm 3.

(2) By adjusting the positions in two of the three dimensions of the inner and outer reinforcing steel bars with the reinforcing steel bar positioning arm mechanism, and adjusting the positions of the inner and outer reinforcing steel bars in the other dimension with the positioning clamps, the three-dimensional positioning is achieved. With the positioning clamps and the plurality of telescopic cylinders, the positioning accuracy is high, and the intervals between reinforcing steel bars are standard.

(3) A fourth telescopic cylinder is provided between the inner side ends of the two small arms for adjusting the distance between the two arm rods, so as to adapt the side wall reinforcing steel bars with different heights.

A positioning method for reinforcing steel bars of tunnel side wall using the positioner for reinforcing steel bars of tunnel side wall above, including the following steps:

The first step, positioning the inverted trestle, wherein one end of the inverted trestle is supported on the paved inverted arch, the other end is supported on the side where the inverted arch is not paved, and the center line of the inverted trestle is parallel to the center line of the tunnel; the second step, extending, shortening and rotating each arm of the reinforcing steel bar positioner so that the position of the reinforcing steel bar positioner in the vertical section of the tunnel is determined (two-dimensional), and then adjusting the distances between the reinforcing steel bar positioning clamps so that the position of the reinforcing steel bar positioner in the length direction of the tunnel is determined (one-dimensional), thereby achieving the three-dimensional positioning of the reinforcing steel bar positioner; the third step, clamping the side wall reinforcing steel bars with the reinforcing steel bar positioning clamps so as to achieve the three-dimensional positioning for the side wall reinforcing steel bars.

Alternatively, the center line of the inverted trestle and the center line of the tunnel are in the same vertical plane.

What is claimed is:

1. A positioner for reinforcing steel bars of a tunnel side wall, comprising an inverted trestle (4), reinforcing steel bar positioning arm mechanisms, positioning rods (5) and positioning clamps (6); wherein at least two groups of the reinforcing steel bar positioning arm mechanisms are provided on a same side of the inverted trestle (4), each group of the reinforcing steel bar positioning arm mechanisms comprises a large arm (1), a medium arm (2) and a small arm (3) that are hinged sequentially from inside to outside; an inner side end of the large arm (1) is hinged at an outer side of the inverted trestle (4), and the large arm (1) is driven by a first telescopic cylinder (7) to rotate around a hinge point, such that the large arm (1) achieves rotation in a horizontal direction; the medium arm (2) comprises three second telescopic cylinders (8) in a Z-shaped arrangement in a vertical plane, such that the small arm (3) achieves rotation or expansion in the vertical plane; the small arm (3) comprises two arm rods vertically arranged at an interval, each of the arm rods is provided with a third telescopic cylinder (9) to achieve telescoping of the arm rod, and a forth telescopic cylinder (10) is provided between inner side ends of the two arm rods for adjusting a distance between the two arm rods of the small arm (3); the small arms (3) of the two groups of the reinforcing steel bar positioning arm mechanisms on the same side are connected to each other through four positioning rods (5), wherein, two of the positioning rods (5) are vertically arranged at an interval on inner sides of the small arms (3), and the other two positioning rods (5) are vertically arranged at an interval on outer sides of the small arms (3), with several positioning clamps (6) being fixedly distributed at intervals on each of the positioning rods (5); reinforcing steel bar positioning clamps (6) on the positioning rods (5) above the inner side are arranged correspondingly to the reinforcing steel bar positioning clamps (6) on the positioning rods (5) below the outer side, the reinforcing steel bar positioning clamps (6) on the positioning rods (5) below the inner side are arranged correspondingly to the reinforcing steel bar positioning clamps (6) on the positioning rods (5) above the outer side, and the reinforcing steel bar positioning clamps (6) on the positioning rods (5) above the inner side are staggered to the reinforcing steel bar positioning clamps (6) on the positioning rods (5) below the inner side.

2. The positioner for reinforcing steel bars of the tunnel side wall of claim 1, wherein, the large arm (1) is in a U-shape, and an opening end of the U-shape faces the inner side, and two end heads of the large arm (1) are hinged to the inverted trestle (4) vertically at an interval; the first telescopic cylinder (7) is arranged vertically and centrally to the large arm (1) so as to ensure that the large arm (1) has a force balance.

3. The positioner for reinforcing steel bars of the tunnel side wall of claim 1, wherein, the arm rods of the small arm (3) can rotate relative to the medium arm (2).

4. A positioning method for reinforcing steel bars of the tunnel side wall using the positioner for reinforcing steel bars of tunnel side wall of, claim 1, comprising the following steps:

a first step, positioning an inverted trestle, wherein one end of the inverted trestle is supported on a paved inverted arch, an other end is supported on a side where the inverted arch is not paved, and a center line of the inverted trestle is parallel to a center line of the tunnel side wall; a second step, extending, shortening and rotating each arm of the reinforcing steel bar positioner so that a position of the reinforcing steel bar positioner in a vertical section of the tunnel side wall is determined, and then adjusting distances between the reinforcing steel bar positioning clamps so that a position of the reinforcing steel bar positioner in a length direction of the tunnel side wall is determined, thereby achieving three-dimensional positioning of the reinforcing steel bar positioner; and a third step, clamping side wall reinforcing steel bars with the reinforcing steel bar positioning clamps so as to achieve three-dimensional positioning for the side wall reinforcing steel bars.

5. The positioning method for reinforcing steel bars of tunnel side wall of claim 4, wherein, the center line of the inverted trestle and the center line of the tunnel side wall are in a same vertical plane.

* * * * *